US005323741A

United States Patent [19]

Holzapfel et al.

[11] Patent Number: 5,323,741

[45] Date of Patent: Jun. 28, 1994

[54] TWELVE-POINT ROCKER-ARM ADJUSTING NUT

[75] Inventors: Michael R. Holzapfel; Robert A. Florine, both of Fillmore, Calif.

[73] Assignee: Automotive Racing Products, Inc., Santa Paula, Calif.

[21] Appl. No.: 82,560

[22] Filed: Jun. 28, 1993

[51] Int. Cl.[5] ..... F01L 1/18

[52] U.S. Cl. ..... 123/90.41; 123/90.43

[58] Field of Search ..... 123/90.33, 90.39, 90.41, 123/90.42, 90.43, 90.45, 90.54

[56] References Cited

U.S. PATENT DOCUMENTS

| | | | |
|---|---|---|---|
| 3,189,011 | 6/1965 | Briggs | 123/90.45 |
| 3,251,350 | 5/1966 | Thompson | 123/90.41 |
| 4,561,392 | 12/1985 | Jette | 123/90.43 |
| 4,784,095 | 11/1988 | Golding et al. | 123/90.41 |
| 4,799,464 | 1/1989 | Patel et al. | 123/90.41 |
| 4,856,467 | 8/1989 | Kronich | 123/90.43 |
| 5,190,000 | 3/1993 | van Schaik et al. | 123/90.41 |

*Primary Examiner*—E. Rollins Cross

*Assistant Examiner*—Weilun Lo

[57] ABSTRACT

A twelve-point rocker-arm adjusting nut (10) designed to be threaded into a rocker-arm stud to adjust the height/clearance between a valve and a rocker arm (44). The nut (10) consists of an axially elongated cylindrical body (12) and a hex-socket tipped set screw (32). the nut (10) has a threaded bore (20) therethrough that extends to near the lower surface (18) of the nut. From this lower surface extends upwardly a thread-free stud entry port (24). Around the upper section of the nut (10) is located a twelve-point wrenching section (26) that includes at its lower end a wrench non-slip lip 30. The wrenching section (26) serves both as a wrench gripping section and for directing oil to provide cooling for the rocker arm base and pivot ball washer (46) interface. To operate the nut (10), a standard twelve-point wrench is used to rotate the nut until the proper height/clearance between the valves and the rocker arm is achieved. A T-handle hex key is then inserted into the hex socket (34) of the screw (32) and rotated to allow the tipped end of the screw to tighten against the upper surface of the stud (40) thus, holding the nut (10) in place.

15 Claims, 1 Drawing Sheet

Fig. 1
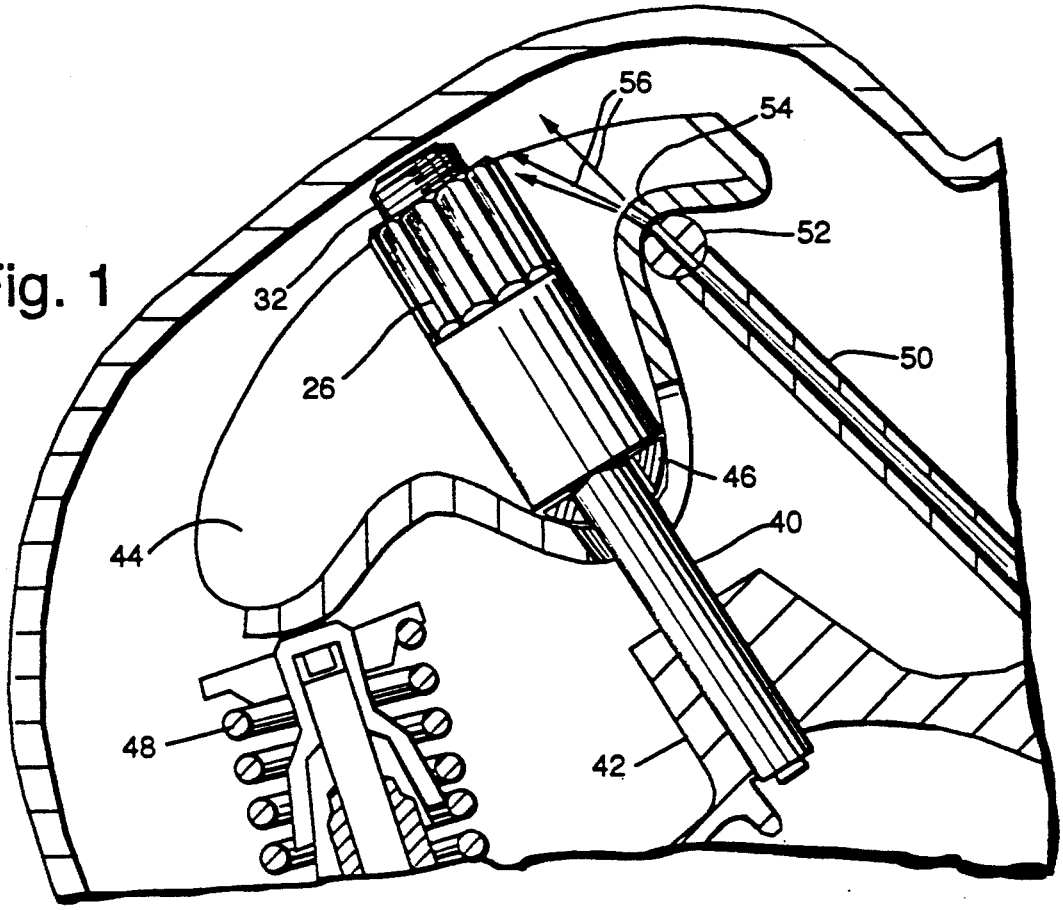
Fig. 2
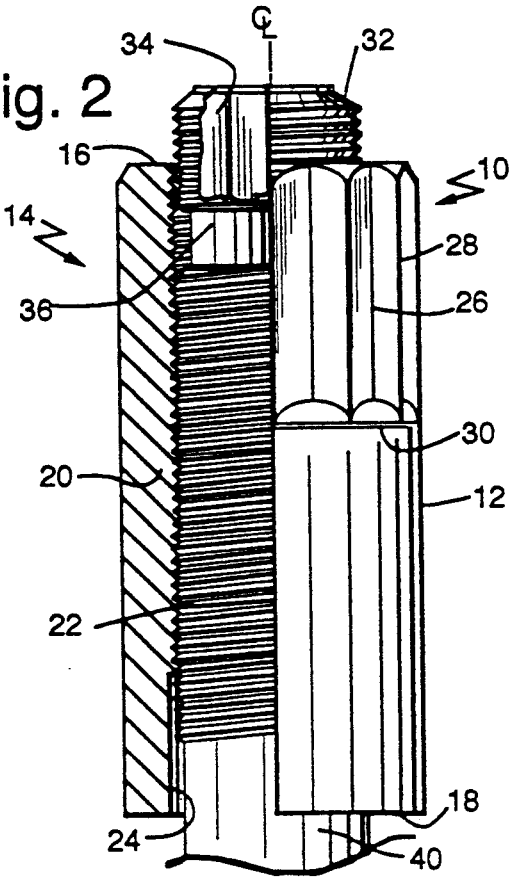
Fig. 3
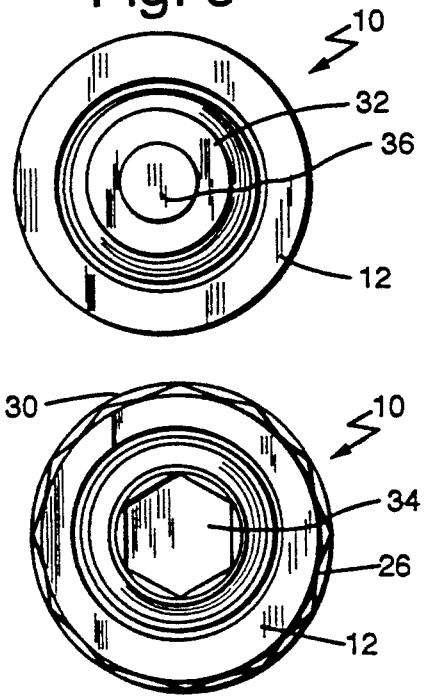
Fig. 4

TWELVE-POINT ROCKER-ARM ADJUSTING NUT

TECHNICAL FIELD

The invention pertains to the general field of rocker-arm adjusting nuts and more particularly to an improved rocker-arm adjusting nut incorporating a twelve-point wrenching section that prevents an adjustment wrench from slipping or vibrating off the nut during the adjustment procedure.

BACKGROUND ART

Conventional overhead-valve internal-combustion engines incorporate a cylinder head in which the intake and exhaust valves are movably mounted and oriented such that the valve stems extend from the valve head in a direction generally away from the top of the cylinder bore. Push rods, engaging valve lifters activated by a cam shaft located in the cylinder section of the engine, extend into the cylinder head alongside the valve stems.

Between each valve stem and its corresponding push rod is a rocker arm pivotally mounted on a rocker-arm stud connected to the cylinder head. The rocker arms are maintained in place by a rocker-arm adjusting nut, whereby a frictional movement occurs between a pivot ball washer and the inner surface base of the rocker arm. The push rod has a bottom end which rests on the cam shaft and moves move up and down as the cam shaft rotates. The up and down motion of the push rod causes the rocker arm to rock back and forth which, in turn, causes the valve which is connected to the rocker arms to also move up and down. When the valve moves up, it seals the combustion chamber thereby stopping the fuel from entering through the engine intake port or leaving through the exhaust port. Thus, it can be seen that it is of the utmost importance that the rocker arm be properly adjusted to enable the valve to completely seal the combustion chamber.

The rocker-arm studs are conventionally attached at their lower end to the cylinder head by either a tight press-fit into a corresponding bore or by threading. The upper end of the rocker arm stud is usually threaded and is received loosely through an elongated hole in the bottom of the rocker arm. Between a spherical bearing surface inside the rocker arm and the upper threaded end of the rocker arm stud is located the pivot ball washer. A locking-type adjusting nut is threaded onto the upper end of the rocker arm stud above the pivot ball washer. This nut is used to adjust the valve lash by moving the rocker arm pivot point up or down by turning the adjusting nut with respect to the fixed rocker arm stud to a selected position.

One of the fundamental problems associated in the manipulation of a rocker arm adjusting nut is in the method and tools required to make the adjustment. In these prior art designs, the wrench used to make the adjustment can easily slip over the body of the nut adding to the difficulty in making a final adjustment. By using the twelve-point rocker-arm adjusting nut of the instant invention in combination with a corresponding twelve-point wrench, the problem of wrench slippage is virtually eliminated and the twelve-point design also prevents the wrench from vibrating off the nut when adjustments are made with the engine running.

A search of the prior art did not disclose any patents that read directly on the claims of the instant invention, however the following U.S. patents are considered related:

| U.S. Pat. No. | INVENTOR | ISSUED |
|---|---|---|
| 4,856,467 | Kronich | 15 August 1989 |
| 4,784,095 | Golding et al | 15 November 1988 |
| 4,561,392 | Jette | 31 December 1985 |
| 3,189,011 | Briggs | 15 June 1965 |

The U.S. Pat. No. 4,856,467 Kronich patent discloses an adjustable valve lash train for an overhead valve engine that includes a rocker-arm stud having a threaded shank received in a threaded bore in the cylinder head. The rocker-arm stud includes a head having a spherically shaped bearing surface that engages a similar shaped bearing surface on the rocker arm and has a hexagonally shaped recess on its top surface for receiving an adjustment tool. A threaded jam nut is located above the threaded shank of the rocker arm stud for locking the threaded shank against rotation with respect to the threaded bore of the cylinder head.

The U.S. Pat. No. 4,784,095 Golding et al patent discloses a rocker arm adjusting nut particularly adaptable for use with steel rocker arms as employed in automotive engines. The nut consists of an integral unit having a hex nut, an upper collar, a bottom flange and an axially elongated body having a central portion provided with axial grooves. The upper collar and grooves in combination, deflect oil axially towards the bottom flange when the nut is in use. The enlarged mass and surface area of the nut also helps, by conduction, to dissipate temperature from the pivot ball-rocker arm interface and deflect oil towards the interface.

The U.S. Pat. No. 4,561,392 Jette patent discloses a girdle assembly for stud mounted rocker arms. The assembly is particularly adapted for use in racing engines where the valve stud structure is unified to prevent stud fatigue failure and adverse harmonics. The girdle is self aligning to the studs over a suitable range of positions, uses clamping forces developed without screws tension in the plane of the girdle and can be readily removed and replaced after being installed.

The U.S. Pat. No. 3,189,011 Briggs patent discloses a self adjusting valve actuating mechanism. The mechanism consists of an arrangement whereby the upper end of the push rod is automatically movable to and from a post having a spherical bearing head. The push rod movement varies its effective length by shifting the position of the cam surface on the cam carrier with respect to the cam follower bearing surface.

For background purposes and as indicative of the art to which the invention is related reference may be made to the following remaining patents found in the search:

| U.S. Pat. No. | INVENTOR | ISSUED |
|---|---|---|
| 4,686,946 | Umeda et al | 18 August 1987 |
| 4,393,820 | Maki et al | 19 July 1983 |
| 4,314,732 | Murphy | 9 February 1982 |
| 3,754,539 | Bandimere | 28 August 1973 |
| 3,219,019 | Palmer | 23 November 1965 |
| RE 24,035 | Leach | 12 July 1955 |

DISCLOSURE OF THE INVENTION

The improved twelve-point rocker-arm adjusting nut is designed to replace conventional hex-head rocker-arm adjusting nuts. The inventive nut is especially suited to provide the proper height/clearance between a valve and the rocker arm that meets the demanding standards of the high performance engines used on vehicles driven by professional drivers. One of the problems with conventional rocker-arm adjustment nuts is that they employ a hex nut. The hex wrench used to make the adjustments is prone to slippage especially when the adjustment is being made with the engine running—which is a common occurrence. This wrench slipping problem is eliminated by the twelve-point design of the instant invention.

The improved twelve-point rocker-arm adjustment nut consists of two basic elements: an axially elongated cylindrical body and an adjustment-nut tightening screw which preferably consists of a hex-socket tipped set screw.

The body which is made of hardened steel, has a bore therethrough that is partially threaded to a point near the lower surface of the nut. This non-threaded portion, which extends from the lower end of the threads to the nut's bottom surface, serves as a rocker-arm stud entry port, which allows the rocker arm to be adjusted before running out of threads. Around the upper section of the body is located a twelve-point wrenching section that is sized to receive and hold a conventional twelve-point wrench. By using a twelve-point configuration, the wrench can be located around the wrenching section in very small and selectable increments. Thus, the adjusting mechanic has more versatility in selecting the particular radial angle that is most comfortable to perform the adjustment. At the lower terminating end of the wrenching section is a circumferential lip that further aids in preventing the twelve-point wrench from slipping below the lip.

The hex-socket tipped set screw is threadably sized to be threaded into the top of the threaded bore on the nut. The screw is preferably rotated by a T-handle hex key. After the adjustment nut has been adjusted so that the valve and rocker arm have the proper clearance, the key is rotated to allow the screw to be rotated and tightened against the upper surface of the rocker-arm stud. Thus, causing the nut to be locked in place at the desired rocker-arm setting.

In view of the above disclosure, it is the primary object of the invention to provide a rocker-arm adjusting nut that directly replaces a conventional rocker-arm adjustment nut and that features a non-slip wrenched section that assures a fast and accurate valve/rocker arm adjustment. In addition to the primary object it is also an object of the invention to provide an rocker arm adjustment nut that:

- has a large and massive body that increases the strength of the nut,
- in addition to performing its primary utility, it also performs a cooling function by directing oil to the interface of the rocker-arm base and pivot ball washer, and
- is cost effective from both a manufacturer's and consumer's point of view.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 1 is a partial sectional and elevational view of a conventional engine showing a stamped steel rocker arm and the placement of a poppet valve spring, a push rod, and a rocker-arm stud attached to a cylinder and projecting through bores in the rocker arm and a pivot ball washer, where the inventive nut is shown threadably attached to the upper section of the stud.

FIG. 2 is a partial sectional and elevational view of the improved twelve-point rocker-arm adjusting nut.

FIG. 3 is a bottom plan view of the nut showing the tip of the hex-socket tipped set screw.

FIG. 4 is a top plan view of the nut showing the hex socket of the hex-socket tipped set screw.

BEST MODE FOR CARRYING OUT THE INVENTION

The best mode for carrying out the improved twelve-point rocker-arm adjusting nut 10 is presented in terms of a preferred embodiment. The inventive nut is designed to be a direct replacement for most of the rocker-arm adjustment nuts currently in use to adjust the rocker arm as described in the background art section. The improved design of the nut also allows it to serve as a combination heat sink and heat exchanging structure that directs heat away from and cools the pivot ball-/rocker arm interface. This cooling is accomplished by virtue of its mass and by directing additional oil flow into the interface.

The preferred embodiment of the improved twelve-point rocker-arm adjusting nut 10 as shown in FIGS. 1–4 is comprised of two separate elements: an axially elongated cylindrical body 12 and a hex-socket tipped set screw 32. The body 12 further consists of an upper section 14, an upper surface 16, a lower surface 18, a bore 20, a set of bore threads 22, a rocker-arm stud entry port 24, a twelve-point wrenching section 26 having longitudinal channels 28 and a lower circumferential lip 30. The nut 10 operates in combination with an internal combustion engine having a valve train assembly that is conventionally used in V-block engines employing overhead valves; such an engine consists of the following major elements; a rocker-arm stud 40, a cylinder head 42, a rocker arm 44, a pivot ball washer 46, a poppet valve spring 48, a push rod 50 having an aperture 52 that emits an oil spray 56 through an orifice 54, and a head cover 58.

The improved twelve-point rocker arm adjusting nut 10 is designed to be threadably inserted into the upper end of the threaded rocker arm stud 40 as shown in FIG. 1. The stud 40 has a lower end that is rigidly attached to a cylinder head 42 and an upper surface that loosely fits through a pair of bores. These bores are concentrically located at the base of the rocker arm 44 and on the pivot ball washer 46 located above the base of the rocker arm 44 as also shown in FIG. 1. The nut 10 in combination with the pivot ball washer 46 pivotally moves and positions the rocker arm 44 to set and maintain the proper height/clearance between a poppet valve (not shown) and the rocker arm. This positioning enables the valve to seal the engine's combustion chamber completely to assure optimum engine performance.

As shown best in FIG. 2, the nut consists of an axially elongated cylindrical body 12 having an upper section 14, an upper surface 16 and a lower surface 18. Through the body is located therethrough, a centered bore 20 that is partially threaded with threads 22 that commence from the nut's upper surface 16. A small section of the bore 20, that extends from the lower surface 16, is thread free and forms an entry port 24 which allows the rocker arm to be adjusted before running out of threads.

The primary novel feature of the nut 10 is the axial twelve-point wrenching section that is located around the upper section 14 of the body 12. The wrenching section which is gripped and rotated by means of a standard twelve-point wrench, provides more versatility than adjustment nuts that utilizes a standard hex head nut. This increased versatility is provided by the fact that the twelve-point wrench can be placed at any angular position around the circumference of the nut. Thus, the rocker arm adjusting can be performed with a comfortable angular position as selected by the adjusting mechanic.

The design of the nut 10 also includes a circumferential lip 30 that is located at the lower end of the wrenching section 26 as shown in FIGS. 2 and 4. This lip prevents a twelve-point wrench inserted over the wrenching section 26 from slipping below the lip 30. Thus, solving the slipping problem that is prevalent when using a standard hex wrench on rocker arms that employ a hex adjustment nut.

In the operation of the engine, oil is flowed through an aperture 52 in the push rod 50 and through an orifice 54 from where the pressurized oil spray 56 is directed outwardly into the cavity of the rocker arm 44 as shown in FIG. 1. The twelve points of the wrenching section also form a set of twelve longitudinal channels 28 as best shown in FIG. 2. These channels aid in directing the pressurized oil spray 56 impinging on the channels downwardly towards the pivot ball washer 46 and its rubbing interface with the base of the rocker arm 44. Thus, providing the additional cooling as described supra.

The second and final element of the nut 10 is the adjustment-nut tightening screw 32. This screw which preferably consists of a hex-socket tipped set screw has threads sized to allow the screw to be threaded into the bore 20 from the upper surface 16 of the nut 10. When the the screw 32 is rotated, by inserting into the hex socket the T-handle hex key, the tipped end of the screw is pressed against the upper surface of the rocker-arm stud 40 allowing the nut 10 to be locked in place. In some situations, it may be desirable to use a hex-socket tipped set screw 32 having a tip made of brass or other malleable material to allow the tip to conform to the upper surface of the rocker-arm stud 40.

In the preferred embodiment the body 12 of the twelve-point rocker arm adjusting nut 10 has the following dimensions:

Length: 1.125 inches (2.858 cm)

Diameter: 0.656 inches (1.667 cm)

Bore thread: 0.375-24 National Fine. The threads commence from the nut's upper surface and extend downwardly 0.875 inches (2.223 cm)

Thread-free port: extends from the lower surface of the nut upwardly for a distance of 0.250 inches (0.635 cm) to the edge of the threaded section.

Wrenching section: commences from the upper surface of the nut and extends downwardly for a distance of 0.375 inches (0.953 cm).

OPERATION

The rocker arm 44 is adjusted by:

1. Placing a twelve-point wrench over the wrenching section 26 of the nut 10,
2. Rotating the wrench until the proper height/clearance between the valve and rocker arm is achieved,
3. After the selected height/clearance is achieved, insert a T-handle hex key into the hex-socket tipped set screw 32. Rotate the handle until the tipped set screw contacts the upper surface of the rocker arm stud 40 and tighten to lock the nut 10 in place.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

We claim:

1. A twelve-point rocker arm adjusting nut designed to be threadably inserted onto the upper end of a threaded rocker-arm stud having a lower end that is rigidly attached to a cylinder head and an upper surface that loosely fits through a pair of bores concentrically located at the base of a rocker arm and on a pivot ball washer located above the base of the rocker arms, wherein said nut in combination with the pivot ball washer, positions the rocker arm to optimally operate a poppet valve, said rocker arm adjusting nut comprising:

a) an axially elongated cylindrical body having an upper exterior section, an upper surface, a lower surface and a bore therethrough that is partially threaded commencing from its upper surface, b) a twelve-point axial wrenching section located on the upper exterior section of said body, and c) an adjustment-nut tightening screw threadably inserted into said bore at the upper surface of said nut, wherein when the lower tip of said screw is rotated and tightened against the upper surface of the rocker arm stud said nut is locked in place.

2. The rocker-arm adjusting nut as specified in claim 1 wherein said body is made of hardened steel.

3. The rocker-arm adjusting nut as specified in claim 2 wherein a small section of said bore extending from the lower surface of said nut is thread free and forms an entry port which allows the rocker arm to be adjusted before running out of threads.

4. The rocker-arm adjusting nut as specified in claim 1 wherein the lower end of said wrenching section terminates upon a circumferential lip that prevents a twelve-point wrench inserted over the wrenching section from slipping below said lip.

5. The rocker-arm adjusting nut as specified in claim 1 wherein said twelve-point wrenching section forms a set of twelve longitudinal channels that aid in directing pressurized oil spray, emitted from (an the) orifice of a push rod and that impinges on the channels downwardly towards the pivot ball and its rubbing interface with the base of the rocker arm.

6. The rocker-arm adjusting nut as specified in claim 1 wherein said adjustment-nut tightening screw comprises a hex-socket tipped set screw.

7. A twelve-point rocker arm adjusting nut designed to be threadably inserted onto the upper end of a threaded rocker-arm stud having a lower end that is rigidly attached to a cylinder head and an upper surface that loosely fits through a pair of bores concentrically located at the base of a rocker arm and on a pivot ball washer located above the base of the rocker arm, wherein said nut in combination with the pivot ball washer positions the rocker arm to optimally operate a poppet valve, said rocker arm adjusting nut comprising:

a) an axially elongated body having an upper surface, a lower surface and,
   (1) a length of 1.125 inches (2.858 cm),
   (2) a diameter of 0.656 inches (1.667 cm),
   (3) a bore therethrough having a set of 0.375–24 national-fine threads commencing from the upper surface of said nut and extending downwardly 0.875 inches (2.223 cm), b) a thread-free entry port that extends from the lower surface of said nut upwardly for a distance of 0.250 inches (0.635 cm) to the edge of said threaded section, wherein said port allows the rocker arm to be adjusted before running out of threads, c) a twelve-point axial wrenching section that commences from the upper surface of said nut and extends downwardly for a distance of 0.375 inches (0.953 cm), and d) an adjustment nut tightening screw consisting of a hex-socket tipped set screw having threads sized to allow said screw to be threaded into the bore from the upper surface of said nut, wherein when the tipped end of said screw is rotated and tightened against the upper surface of the rocker-arm stud said nut is locked in placed.

8. The rocker-arm adjusting nut as specified in claim 7 wherein said body is made of hardened steel.

9. The rocker-arm adjusting nut as specified in claim 7 wherein the lower end of said wrenching section terminates upon a circumferential lip that prevents a twelve-point wrench inserted over the wrenching section from slipping below said lip.

10. A twelve-point rocker arm adjusting nut designed to be threadably inserted onto the upper end of a threaded rocker-arm stud having a lower end that is rigidly attached to a cylinder head and an upper surface that loosely fits through a pair of bores concentrically located at the base of a rocker arm and on a pivot ball washer located above the base of the rocker arms, wherein said nut in combination with the pivot ball washer, positions the rocker arm to optimally operate a poppet valve, said rocker arm adjusting nut comprising:

a) an axially elongated cylindrical body having an upper exterior section having a first outer diameter, a lower exterior section having a second outer diameter, an upper surface, a lower surface and a bore therethrough that is partially threaded commencing from its upper surface, said first outer diameter substantially the same as said second outer diameter, said upper exterior section generally contiguous with said lower exterior section, b) a twelve-point axial wrenching section located on the upper body of said body, and c) an adjustment-nut tightening screw threadably inserted into said bore at the upper surface of said nut, wherein when the lower tip of said screw is rotated and tightened against the upper surface of the rocker arm stud said nut is locked in place.

11. The rocker-arm adjusting nut as specified in claim 10 wherein said body is made of hardened steel.

12. The rocker-arm adjusting nut as specified in claim 11 wherein a small section of said bore extending from the lower surface of said nut is thread free and forms an entry port which allows the rocker arm to be adjusted before running out of threads.

13. The rocker-arm adjusting nut as specified in claim 10 wherein the lower end of said wrenching section terminates upon a circumferential lip that prevents a twelve-point wrench inserted over the wrenching section from slipping below said lip.

14. The rocker-arm adjusting nut as specified in claim 10 wherein said twelve-point wrenching section forms a set of twelve longitudinal channels that said in directing pressurized oil spray, emitted from the orifice of a push rod and that impringes on the channels downwardly toward the pivot ball and its rubbing interface with the base of the rocker arm.

15. The rocker-arm adjusting nut as specified in claim 10 wherein said adjustment-nut tightening screw comprises a hex-socket tipped set screw.

* * * * *